United States Patent [19]

Frydlender

[11] 3,978,568

[45] Sept. 7, 1976

[54] APPARATUS FOR TREATING LIPSTICK AND LIKE SUBSTANCES

[75] Inventor: Charles Frydlender, Annecy, France

[73] Assignee: SEBEC Société d'Exploitation de Brevets d'Emballage Cosmétique S.A., Fribourg, Switzerland

[22] Filed: June 30, 1975

[21] Appl. No.: 592,048

[30] Foreign Application Priority Data

July 11, 1974 France ..... 74.24096

[52] U.S. Cl. ..... 29/200 D; 29/33 K; 29/208 E; 29/208 F

[51] Int. Cl.[2] ..... B23F 19/00

[58] Field of Search..... 29/208 E, 208 F, 200 D, 29/33 K; 401/68, 116; 206/385

[56] References Cited

UNITED STATES PATENTS

| | | | |
|---|---|---|---|
| 2,155,958 | 4/1939 | Schmidt | 29/208 E |
| 2,173,600 | 9/1939 | Thompson | 401/116 X |
| 2,491,723 | 12/1949 | Gelardin | 401/68 X |
| 3,141,278 | 7/1964 | Wysocki | 29/208 F UX |
| 3,188,727 | 6/1965 | Davis | 29/208 F |
| 3,193,915 | 7/1965 | Gillie et al. | 29/200 D X |
| 3,566,508 | 3/1971 | Ruscitti | 29/208 E |
| 3,702,138 | 11/1972 | Abrahamsson et al. | 29/200 D X |
| 3,807,022 | 4/1974 | Bredow | 29/208 E X |
| 3,924,315 | 12/1975 | Cady et al. | 29/200 D |

FOREIGN PATENTS OR APPLICATIONS

| | | |
|---|---|---|
| 1,360,463 | 3/1964 | France |
| 1,398,144 | 3/1965 | France |
| 2,076,609 | 10/1971 | France |

*Primary Examiner*—Charlie T. Moon
*Attorney, Agent, or Firm*—Michael J. Striker

[57] ABSTRACT

A process and machine are provided for handling lipsticks and similar stick-shaped materials in containers of the kind comprising a body and base which are rotated relatively—to project and retract the stick. The container is transported between stations at which successively the stick is caused to project, a mold enveloping the stick is removed, the stick is then caused to project further and is polished by flaming or dipping, then the stick is retracted into the container and the container is ejected.

9 Claims, 6 Drawing Figures

APPARATUS FOR TREATING LIPSTICK AND LIKE SUBSTANCES

The present invention relates to the treatment of lipsticks and other substances of similar physical characteristics, cast in individual moulds inside containers which are of a kind having a mechanism for projecting the lipstick by rotation of the body of the container with respect to its base.

This manner of casting and these containers are well known. They have been described in particular in French Patents Nos. 1,389,144; 1,360,463 and 2,076,609.

The mould is generally in the form of a thin-walled hollow so-called ogive or sheath made of plastics material and fitting onto the lipstick-carrying cup or godet of the container. The rotatable base of the container and the cup are provided with holes for pouring in the molten paste (with the container inverted) to fill the sheath and the cup. After cooling, the solidified paste forms a lipstick having the shape of the inside of the sheath and of the cup or godet.

It is possible to leave the lipstick in its sheath, in which it was cast, inside the container until the moment when the lipstick is first used; it is then only necessary to cause the lipstick, complete with its sheath, to project fully from the container by rotating of the body of the container with respect to its base, then to retract the lipstick slightly into the container to cause the lipstick to withdraw from the sheath and allow the sheath to be ejected.

This known manner of use achieves the maximum guarantee of integrity and hygiene to the user of the lipstick. All the same, the appearance of the lipstick, after removal from its mould in this way, could be considered to be insufficiently aesthetically attractive by customers used to lipsticks cast in the normal manner and polished after removal from the mould by flaming or oiling. In other cases it may be necessary to apply to the surface of the stick a protective layer which insulates from the atmosphere the still unused part of the stick. Finally, certain users find it tiresome or inconvenient to have to remove the sheath from the stick themselves before use, with its risk of scratching the stick by mishandling on removal of the sheath, or even of breaking the stick through trying to replace the sheath after use of the stick.

To overcome these drawbacks of the known method of manufacture it is thus desirable to provide a process and a machine for putting it into practice, that allows one to remove the stick from its sheath, to eject the sheath, to treat the surface of the stick and to retract the stick into the container, with the maximum guarantee of hygiene to the user and using a manufacturing sequence compatible with a low selling price, and without contact with human hands.

According to the invention there is proposed a process for removing from their moulds and shaping lipsticks or other stick-shaped substances of similar physical characteristics, cast in individual moulds inside container of a kind having a mechanism for projecting the stick by rotation of the body of the container with respect to its base, distinguishing the feature that the containers are mounted on transporting means which carry them in a manner which leaves them free to rotate, one after the other, to fixed treatment stations at which, successively: the body of the container is caused to turn with respect to its base to cause the stick, in its mound, to project, the mould is ejected to release the stick, the stick is treated, the body of the container is turned with respect to its base to retract the treated stick into the container, and then the container is disengaged from the transporting means.

The treatment of the sticks could take the form of surface melting (e.g. by flaming) or coating.

In modification, before the containers are removed from the transporting means and transferred to a suitable fixed station, a casing member is fitted to the base of the container, then there is fitted onto the body of the container a cover or cap which fits onto the casing member.

The invention also relates to a machine for putting such a process ito practice.

A machine according to the invention is characterised in that it comprises a fixed structure carrying a rotatable circular table with a mechanism for indexing it round step by step and carrying, evenly spaced around its periphery, a number of resilient grippers, each designed to hold a container, and a number of treatment stations spaced around the table and comprising a feed-in station to receive containers which contain sticks cast in their individual moulds, all orientated in the same sense and parallel to the axis of rotation of the table, comprising means for inserting the containers individually, each in one gripper, by pushing the containers laterally in a radial direction towards the axis of the table, a projecting station for the stick comprising means for rotating relatively the body and the base of the container in a direction such as to cause the stick to project out of the container, a removal station for the mould comprising means for disengaging the mould from the stick in a direction along the aix of the container, and means for ejecting the mold, a station for treating the cast sticks by surface polishing, a station for retracting the sticks into the containers comprising means for rotating relatively the body and the base in a direction such as to retract the stick into the container, and a station for disengaging the containers from the resilient grippers and ejecting the containers, comprising means for pushing the containers laterally in a radial direction away from the axis of the plate.

In one preferred embodiment the projection of the stick with its mould and the removal of the mould are combined at the same station comprising a jaw for gripping and momentarily immobilising the base of the container while the container is at the said station, first rotating means for partially projecting the stick, complete with its mould, out of the container, means for gripping and axially pulling the mould out of the container, then for releasing and ejecting the mould, and second means for rotating the body releative to the base further in the same direction for causing the stick to project fully from the container.

The rotating means could comprise rollers which frictionally engage the body of the container, rack and pinion means for rotating the rollers, first means for acting on the rack in a direction causing the stick to be projected out of the container, second means for moving the rack further in the same direction, and means for returning the rack in opposite direction.

The station for causing surface polishing of the sticks removed from their moulds could comprise a bath with a constant-level feed containing a surface-polishing liquid and means for momentarily lifting the bath to immerse the downwardly pointing stick in the liquid.

As the polishing liquid once could use a solution of silicone oil in a volatile solvent.

As an alternative, the polishing station could comprise means for momentarily heating the surface of the freed stick to a temperataure at least equal to the melting temperature of the material of the stick, for example by the use of a flame.

The station at which the treated stick is retracted into the container may comprise jaws for momentarily holding the base of the container while the container is halted at the station, a roller for rotating the body of the container by friction, rack and pinion means for rotating the roller, and means for moving the rack linearly.

The station for ejecting the containers, from the grippers on the table could comprise a fixed ramp placed along a line intersecting the periphery of the table, against which the containers, come into engagement and slide until they are released.

The means for operating the various moving members of tahe machine preferably comprise rams and a sequence control mechanism programmed to operate from a single source of fluid under pressure.

The invention will be better understood by reading the following detailed description and by examination of the accompanying drawings, illustrating one embodiment of the invention.

Figure 1:
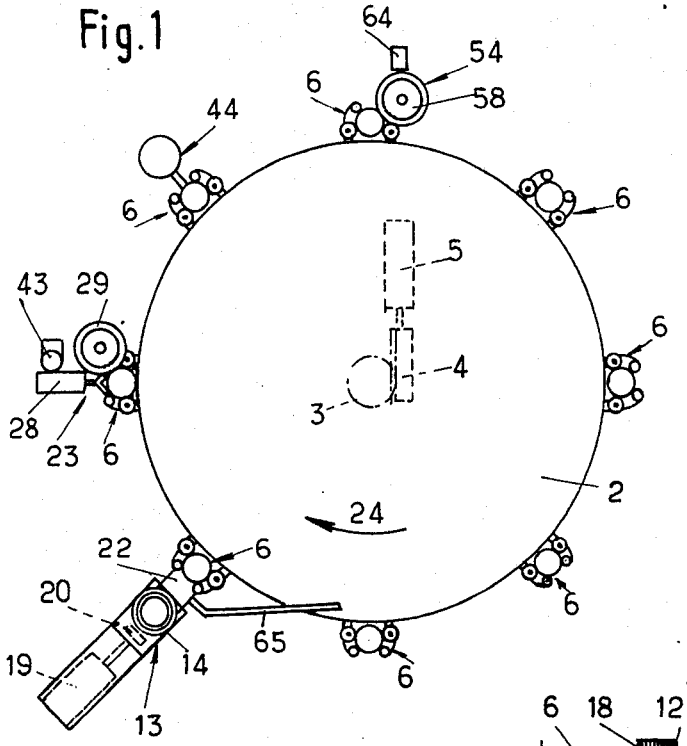
FIG. 1 is a diagrammatic plan view of a machine according to the invention.

The machine illustrated in FIGS. 1 to 6 comprise a generally fixed structure 1 carrying a horizontal rotatable table 2 with a mechanism for indexing it angularly step by step by means of a toothed wheel 3 with a non-return ratchet and an actuating rack 4 operated by a ram 5 (FIG. 1).

Figure 2:
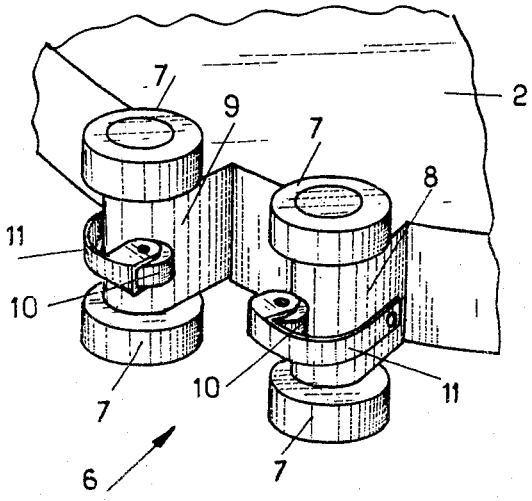
FIG. 2 is a diagrammatic perspective view of a gripper for the container on the table of the machine of FIG. 1.

The table 2 carries a plurality of grippers 6 each comprising four ball bearings 7 rotatably mounted on extensions 8,9 of the structure 1 and two freely rotatable rollers 10 mounted on leaf springs 11 (FIG. 2).

Figure 3:
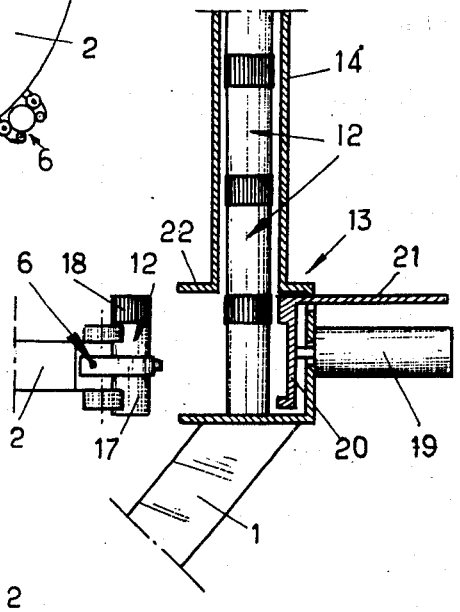
FIG. 3 is a diagrammatic elevation, partially in section, of the feed-in station for containers to be treated, combined with the ejection station for the treated containers.

At the feed-in station 13, a container 12 is inserted resiliently into each gripper and is then held but is free to rotate; at the station 13 there is a tube 14 into which there are fed in succession, all facing the same way, the containers 12 to be treated, each including a lipstick 15 in its casting mould or sheath 16: the body 17 of the container is downwards and the rotatable base 18 is uppermost, the feeding being by known means, not shown, for example a vibrating hopper, best supplied by hand. A ram 19 of which the piston rod 20 is extended to form a slide 21, inserts the containers one by one in succession into the grippers 6 by pushing them radially inwards towards the axis of the table along a guide passage 22 and in step with the indexing of the table 2. The slide 21 prevents the containers 12 that are waiting in the tube 14 from dropping into the passage 22 when the ram 19 pushes a container 12 into a gripper 6 (FIG. 3).

A fixed ramp 65, secured to the structure 1 and forming an extension of the feed-in station 13 which is upstream with respect to the direction of rotation 24 of the table 2, is arranged along a line intersecting the periphery of the table 1 parallel to, and extending just above, the upper rollers 7 of the gripper 6. Thus when the table 2 is indexed round by one stp the bae 18 of the treated container 12 which was held resiliently by the gripper 6, moved by this indexing towards the feed-in station 13, is pushed radially outwards away from the axis of the table by the ramp 65 which thus resiliently disengages the container 12 from the gripper 6 and the container falls into a receiving bin, not shown (FIG. 1).

Figure 4:
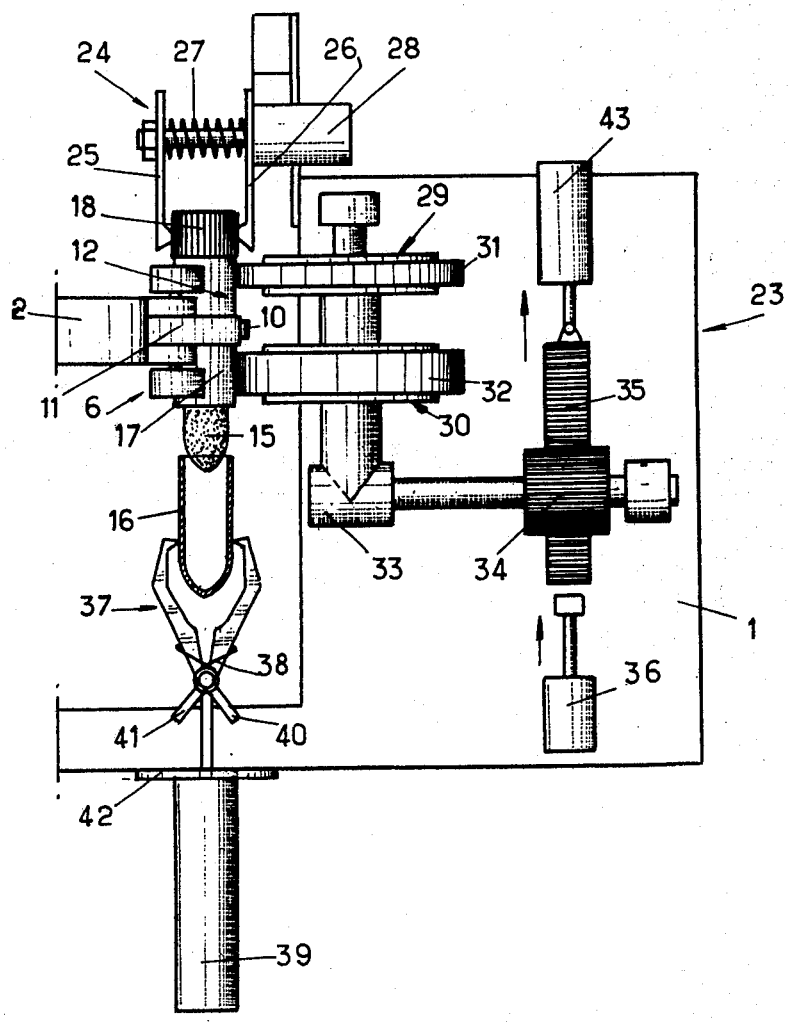
FIG. 4 is a diagrammatic elevation of the combined station for projecting the stick and removing the mould.
Figure 5:
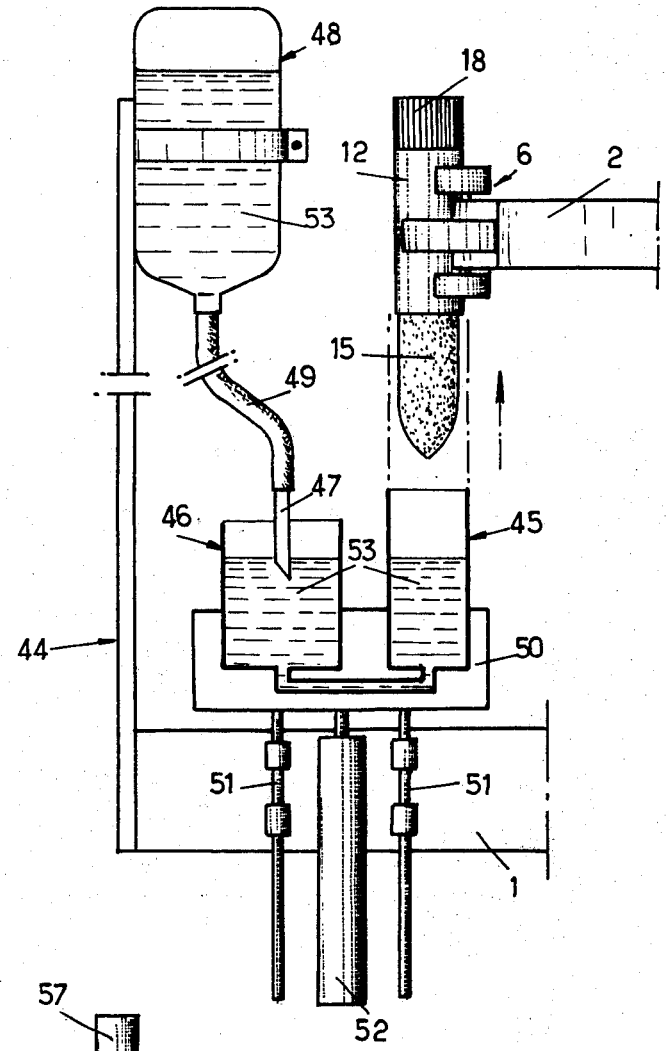
FIG. 5 is a diagrammatic elevation of the station for treating the sticks which have been removed from their moulds.

Indexing of the table 2 through one step transfers a container 12 to a combined station 23 for projecting the stick 15 and for ejecting the casting mould or sheath 16. At this station 23 the base 18 of the container 12 is held stationary by a gripper 24 of which the jaws 25, 26, normally held spread apart by a spring 27, are closed by a ram 28 (FIG. 4).

Two rollers 29 and 30 with resilient tyres 31 and 32 and joined together, press resiliently against the body 17 of the container 12, respectively above and below the leaf springs 11 which carry the rollers 10 of the gripper 6. They rotate the body 17 by friction while the base 18 of the container 12 is held fixed, they themselves being rotated through an angle drive 33 by means of a pinion 34 engaged by a rack 35. This rack 35 is actuated by the free engagement against one of its ends of a first ram 36 to push it to the position shown in FIG. 4, in which the lipstick 15 is caused to project partially to allow the casting mould 16 to be ejected by a gripper 37 with pointed jaws, normally maintained closed by a spiral spring 38 and between which the sheath or mould 16 is inserted. The gripper 37, engaging the sheath 16, is withdrawn by a ram 39 until arms 40,41 which form extensions of the jaws come into engagement with the front face 42 of the ram 39 which causes the jaws to open and release the ejected sheath 16. Then a second ram 43 attached to the other end of the rack 35 draws it to the end of its travel in the same direction as before, causing the stick 15, from which the mould has been removed, to project fully from the container 12, (FIG. 4).

The gripper 24 then releases its hold under the action of the spring 27 following release of the pressure in the ram 28, freeing the container 12. The table 2 can now be indexed round by one step and transfers this container 12 to a polishing station 44. During this movement the supplies to the ram 36,39 and 43 are reversed, releasing the jaws 37 and returning the rack 35 to its starting point ready to rotate rollers 31, 32 once again.

The polishing station 44 comprises essentially a cylindrical bath 45 arranged on a downward extension of the axis of the downwardly pointed stick 15 of a contaier 12 held at this station. This bath 45 is in communication with a reservoir 46 fed to a constant level with a polishing liquid 53 through a tube 47 fixed to the reservoir 46 and fed through a flexible pipe 49 from a feeding reservoir 48 mounted on a fixed post and having no other communication with atmosphere. The bath 45 and the reservoir 46 with its tube 47 are fixed to a support 50 guided by two rods 51 sliding in an extension of the structure 1. For a brief moment a ram 52 shifts the support 50 vertically upwards to an upper position (shown in chain-dotted lines in FIG. 5) at which the stick 15, which is thus introduced into the bath 15, is wholly immersed in the liquid 53.

As a polishing liquid one could use a solution of about 6 percent of silicone oil, fo the type sold commercially under the name "S120/50", in trichlorotrifluoromethane of the type sold under the name "Freon 113".

Reversal of the ram 52 returns the support 50 to its lower position (shown in full lines in FIG. 5), freeing completely the conainer 12 with its polished stick 15 and allowing a fresh indexing movement of the table 2 through one step.

This fresh movement brings the container 12 to a station 54 for returning the stick 15, now polished, into the container 12.

Figure 6:
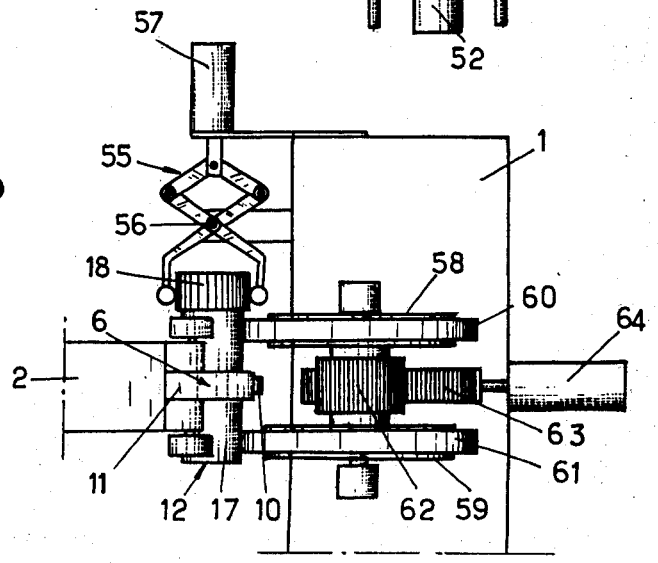
FIG. 6 is a diagrammatic elevation of the station at which the treated sticks are retracted.

At this station 54 a scissors-action gripper 55 ppivoted at 56 on an extension of the structure 1 and actuated by a ram 57 grips and holds the base 18 of the container 12. Two rollers 58,59 with resilient tyres 60,61 and joined together press resiliently against the body 17 of the container, respectively above and below the leaf springs 11 which carry the rollers 10 of the gripper 6. They rotate the body 17 by friction while the base 18 of the container 12 is held fixed, being themselves rotated by a pinion 62 engaged by a rack 63 actuated by a ram 64 in a direction causing the stick 15 to be retracted into the container 12 (FIG. 6).

Then the gripper 55 is opened by the ram 57, releasing the base 18 of the container 12 and allowing a fresh indexing movement of the table 2 through one step.

The container 12, the treatment of which has now been completed, is transferred step by step back to the station 13 where the ramp 65 ejects it from the machine.

In such a machine the correct actuation in sequence of the various rams can be ensured in a known manner, operating from a source of fluid pressure through the appropriate action of control valves detecting the positions of the moving members.

Modifications are possible; for example, whereas the machine described and illustrated has twice as many grippers as operating station, it would be possible to double its production by installing at the unoccupied positions a further complete set of stations identical with those illustrated.

Equally, the rotating table could have a different number of grippers, provided there is a number appropriate to the number of operating stations.

Finally other manners of design and operation of the components of the machine could be contemplated within the scope of the invention, for example the substitution of solenoids instead of rams, or the ejection of the casting mould by projecting the stick, with the mould on its, fully then partically retracting the stick to disengage the mould from the stick and allow the mould to fall away by gravity, then projecting the stick fully again before transfer to the polishing station, or again the body of the container could be held still while the rollers rotate the base (the inverse of what is described in the example) to project and retract the stick.

It would also be possible to associate with such a machine arrangements for further treatment, in particular a station for labelling the finished container.

I claim:

1. A machine for putting into practice the process for removing moulds from, and for treating lipsticks and other substances of similar physical cahracteristics cast in individual moulds inside containers of a kind having a body an a base mechanism for projecting the stick by rotation of said body with respect to said base, comprising a fixed structure, a round table rotatable about an axis on said structure, a mechanism for indexing said table angularly step by step and, uniformly distributed around its periphery, a plurality of resilient individual grippers for said containers regularly spaced apart, a plurality of fixed treatment stations spaced around said table and comprising a feed-in station for said containers containing cast sticks in their individual molds, all facing the same direction and parallel to the axis of rotation of the table, said feed-in station comprising means for inserting said containers individually, each in one gripper, by pushing said containers laterally in a radial direction towards the axis of said table, a station for projecting the stick, said projecting station comprising means for rotating relatively the body and the base of said container in a direction such as to project said stick out of said container, a station for ejecting the hold, said mold-ejecting station comprising means for releasing said mold from said stick along the axis of said container and means for ejecting the mold, a station for polishing said sticks by surface treatment, a station for retracting said sticks into said containers, said retracting station comprising means for rotating relatively said body and said base in a direction such as to retract said stick into the container, and a station for ejecting the containers, said container ejecting station comprising means for pushing said containers laterally in a radial direction away from the axis of said table.

2. The machine set forth in claim 1 wherein said projecting station and said mold-ejecting station are combined in one and comprise a gripper for engaging and momentarily holding the base of said container while it is at the said station, first rotating means for causing the stick with its mold to project partially out of said container, means for gripping and axially pulling said mold away from said container, then ejecting said mold, and second rotating means for causing further rotation in the same direction to cause said stick to project fully from said container.

3. The machine set forth in claim 2 wherein said rotating means comprise roller means for frictionally engaging and rotating the body of said container, rack and pinion and means for rotating said roller means, first means for moving said rack in a direction such as to cause said stick to project from the container, second means for moving said rack further in the same direction to cause said stick to project fully, and means for causing reverse movement of said rack.

4. The machine set forth in claim 1 wherein said polishing station comprises a bath with a constant level supply of polishing liquid and means for momentarily immersing a downwardly pointing stick in said liquid by an upward movement of said bath.

5. The machine set forth in claim 4 wherein said polishing liquid is formed by a solution of silicone oil in a volatile solvent.

6. The machine set forth in claim 1 wherein said polishing station comprises means for momentarily heating the surface of said stick to a temperature at least equal to the melting temperature of the material of said stick.

7. The machine set forth in claim 1 wherein sadi retracting station comprises a gripper for holding the base of said container while it is at the said station, roller means for frictionally engaging and rotating the body of said container, rack and pinion means for rotating said roller means and means for linearly moving said rack.

8. The machine set forth in claim 1 wherein said container-ejecting station comprises a fixed ramp arranged along a line intersecting the periphery of said table, against which said containers held in said grippers are caused to come and slide during rotation of said table.

9. The machine set forth in claim 1 including fluid-pressure rams and a sequential control mechaanism to cause movement of the movable members thereof.

* * * * *